US006978106B2

(12) United States Patent
Masuda

(10) Patent No.: US 6,978,106 B2
(45) Date of Patent: Dec. 20, 2005

(54) DEVELOPING APPARATUS HAVING MODIFIED DEVELOPER CARRYING CAPABILITY

(75) Inventor: Koji Masuda, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 10/729,941

(22) Filed: Dec. 9, 2003

(65) Prior Publication Data

US 2004/0114966 A1 Jun. 17, 2004

(30) Foreign Application Priority Data

Dec. 12, 2002 (JP) ..... 2002-361388

(51) Int. Cl.[7] ..... G03G 15/08
(52) U.S. Cl. ..... 399/260; 399/256; 399/360
(58) Field of Search ..... 399/258–263, 399/358–360, 256

(56) References Cited

U.S. PATENT DOCUMENTS 5,204,721 A * 4/1993 Sharpe ..... 399/256
5,682,584 A * 10/1997 Hattori et al. ..... 399/255
6,449,441 B2 9/2002 Masuda ..... 399/58
2003/0072588 A1 4/2003 Sakemi et al. ..... 399/223

FOREIGN PATENT DOCUMENTS

| | | | | |
|---|---|---|---|---|
| JP | 59-100471 | | 6/1984 | |
| JP | 2-21591 | | 5/1990 | |
| JP | 06274030 | A * | 9/1994 | ..... G03G 15/08 |
| JP | 2001083802 | A * | 3/2001 | ..... G03G 15/08 |
| JP | 2001343825 | A * | 12/2001 | ..... G03G 15/08 |

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A developing apparatus having a developing container for containing developer including toner and carrier, and developing an electrostatic image formed on an image bearing member, includes a carrying member for carrying the developer in the developing container, and a discharge port provided in the developing container for discharging any excess developer resulting from the supply of the developer. The developer carrying capability of the carrying member is greater in an area near the discharge port than in an area downstream of the discharge port in the carrying direction of the developer.

7 Claims, 6 Drawing Sheets

DEVELOPING APPARATUS HAVING MODIFIED DEVELOPER CARRYING CAPABILITY

BACKGROUND OF THE INVENTION

1. Field of the Invention

The invention relates to a developing apparatus for developing an electrostatic image formed by the use of an electrophotographic process or an electrostatic recording process, and particularly to a developing apparatus for use in a copying machine, a printer, a facsimile apparatus or the like.

2. Description of the Related Art

In conventional image forming apparatuses, and above all, image forming apparatuses of an electrophotographic type for effecting color image forming, there has been widely utilized a two-component developing process using a mixture of a nonmagnetic toner and a magnetic carrier as a developer.

The two-component developing process, as compared with presently proposed other developing processes, has such merits as the stability of image and the durability of the apparatus, while on the other hand, it has unavoidably suffered from the deterioration of the developer, particularly the deterioration of the carrier, due to long-period endurance and therefore, it is necessary to do the work of interchanging the developer with the long-period use of the image forming apparatus.

On the other hand, in the recent full-color copying machines/printers, for the curtailment of running costs, the introduction of the following technique has been progressed as a method of maintaining a high quality of image without doing the work of interchanging the developer.

For example, according to Japanese Patent Publication (Koukoku) No. 2-21591, "in a developing apparatus for an electrophotographic copying machine provided with agitating means for agitating a carrier and a toner, and a developing roll for supplying a developer agitated by the agitating means to a photosensitive member, a carrier supplying device and a toner supplying device are separating or integrally provided above the agitating means, and a developer overflowing portion is provided in the side wall of the housing of a developing apparatus and therefore, a fresh developer can be supplied little by little by the supplying devices and also can be discharged from the developer overflowing portion, and the characteristic of the developer in the housing of the developing apparatus can be maintained constant with a result that the quality of the image of a copying can also be kept constant," and "the oldened developer in the housing of the developing apparatus is sequentially automatically discharged from the developer overflowing portion and therefore, the cumbersome developer interchanging work of removing the developing apparatus from the copying machine, taking out the old developer in the housing of the developing apparatus and refilling the housing with a fresh developer, and thereafter mounting the developing apparatus again becomes unnecessary and moreover, the scattering of the developer is prevented and this is hygienic".

That is, the deteriorated developer (carrier) is gradually changed with fresh material, whereby the progression of the apparent deterioration of the carrier is stopped and as to the entire developer, the characteristic thereof is stabilized. Thereby, the work of interchanging the developer is made unnecessary and a maintenance property is improved.

In the recent full-color copying machines/printers, however, in order to achieve a high quality of image, the smaller particle diameters of the toner and carrier in the developer have been progressed, but when the toner and carrier are made small in particle diameter, a change in the triboelectricity of the developer for a change in the amount of moisture in the atmosphere becomes great. Along therewith, a change in the bulk density of the developer in the developing apparatus also becomes great. Specifically, when the amount of moisture becomes small, the triboelectricity becomes high and the bulk density becomes low. Conversely, when the amount of moisture becomes great, the triboelectricity becomes low and the bulk density becomes high.

When in this state, the amount of developer is made constant, the bulk density becomes low and the level of the developer rises, or the bulk density becomes high and the level of the developer falls.

In the conventional art, as described above, the method adopted is a method of providing a developer overflowing portion, i.e., a developer discharge port, in the side wall of the developing apparatus, effecting the discharge of the developer by overflow, and maintaining the level of the developer constant.

However, when as described above, the level of the developer is not stable due to a change in the bulk density of the developer, the discharge of the developer is not effected suitably, and the balance between the amount of supplied developer and the amount of discharged developer becomes bad and the amount of developer in the developing apparatus is gradually increased and the level of the developer rises.

Consequently, when the level of the developer at the other locations than the developer discharge port becomes too high when the developer is discharged through the developer discharging port, if the amount of developer is too much increased due to the faulty agitation of the supplied toner or the above-described change in the bulk density of the developer, there has been a case when overtorque occurs and such a problem that a high quality of image cannot be maintained arises.

SUMMARY OF THE INVENTION

It is an object of the present invention to provide a developing apparatus which can gradually automatically interchange a developer and improve a maintenance property, and yet can discharge any excess developer with good sensitivity.

It is another object of the present invention to provide a developing apparatus which adopts a construction for gradually automatically interchanging a developer, and yet can increase the amount of developer contained in a developing container.

It is still another object of the present invention to provide a developing apparatus having:

a developing container for containing therein a developer including a toner and a carrier, and developing an electrostatic image formed on an image bearing member;

a carrying member for carrying the developer in the developing container; and a discharge port provided in the developing container for discharging therethrough any excess developer resulting from the supply of the developer, wherein the developer carrying capability of the carrying member is greater in an area near the discharge port than in an area downstream of the discharge port in the carrying direction of the developer.

Further objects of the present invention will become apparent from the following detailed description when read with reference to the accompanying drawings.

DESCRIPTION OF THE PREFERRED EMBODIMENTS

A developing apparatus, a developing cartridge and an image forming apparatus according to the present invention will hereinafter be described in greater detail with reference to the drawings.

First Embodiment

Figure 1:
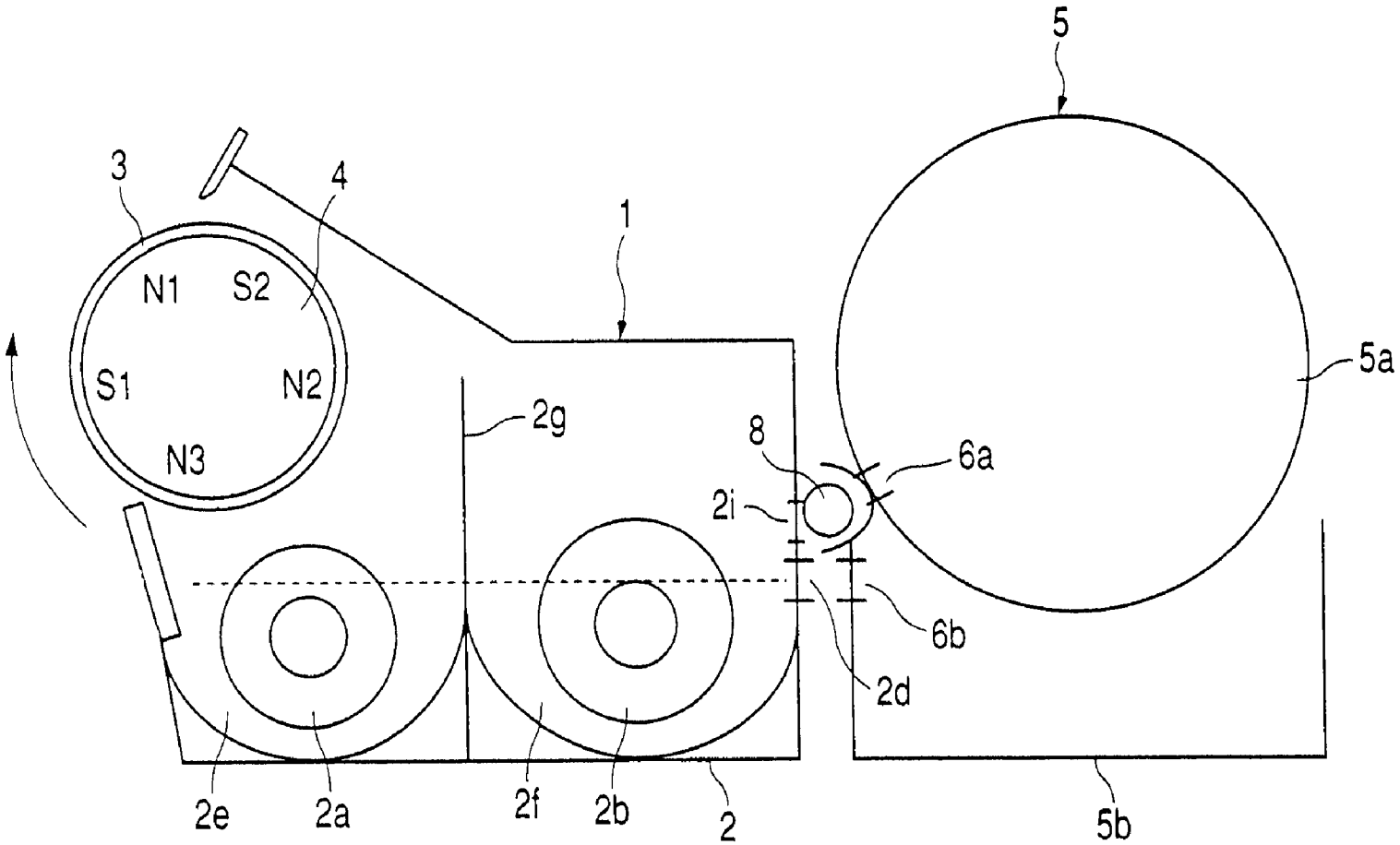
FIG. 1 is a cross-sectional view showing an example of each of a developing apparatus, a supplying container and a collecting container according to the present invention.
Figure 5:
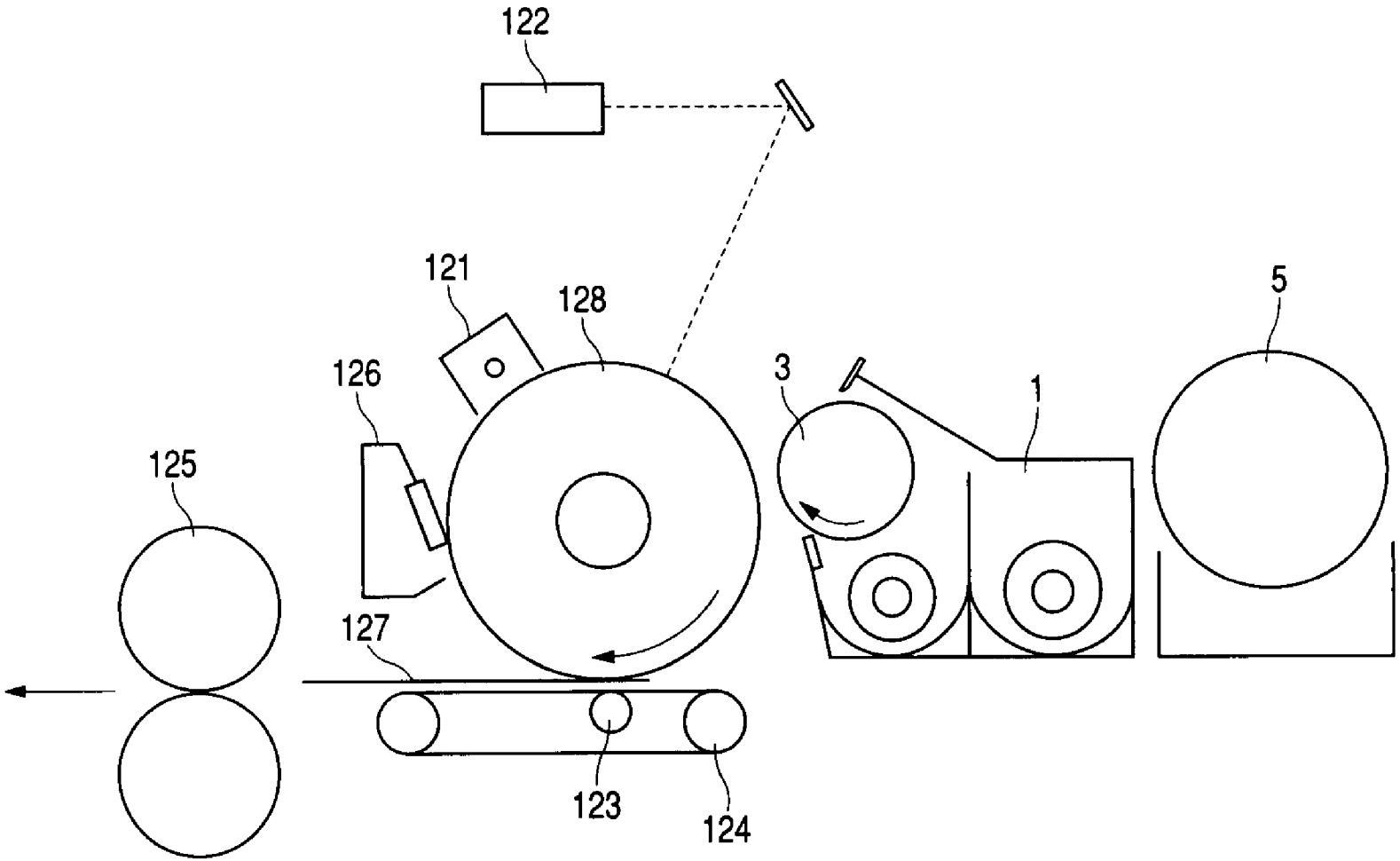
FIG. 5 is a schematic view showing the construction of an example of an image forming apparatus according to the present invention.

FIG. 1 illustrates a developing apparatus according to a first embodiment of the present invention, and FIG. 5 illustrates an example of an image forming apparatus using this developing apparatus.

Description will first be made of the operation of the entire image forming apparatus. The image forming apparatus in the present embodiment has a drum-shaped electrophotographic photosensitive member (photosensitive drum) 128 as an image bearing member, and in FIG. 5, the surface of the photosensitive drum 128 charged by a charging device 121 is first exposed by a laser 122 to thereby form an electrostatic latent image on the photosensitive drum 128, and this latent image is developed by the developing apparatus 1 to thereby form a developer image (toner image) on the photosensitive drum 128.

This toner image is transferred to recording paper 127 transported by a transferring belt 124, by a transferring bias from a transfer charging device 123, whereafter the recording paper 127 is stripped off from the transferring belt 124, and is pressurized and heated by a fixing device 125 to thereby obtain a permanent image. Also, any untransferred toner residual on the photosensitive drum 128 after the transfer is removed by a cleaner 126, and the photosensitive drum 128 becomes ready for the next image forming.

The developing apparatus 1 will now be described in detail with reference to FIG. 1.

The developing apparatus 1 contains therein a two-component developer including a nonmagnetic toner and a magnetic carrier, and the mixing ratio thereof is about 1:9 by weight ratio. This ratio should be properly adjusted in accordance with the charged amount of the toner, the particle diameter of the carrier, the construction of the image forming apparatus, etc. and need not always follow this numerical value.

The developing apparatus 1 is such that the developing area thereof facing the photosensitive drum 128 opens and a developing sleeve 3 which is a developer carrying member is rotatably disposed in this opening portion in such a manner as to be partly exposed. The developing sleeve 3 containing therein a stationary magnet 4 which is magnetic field producing means is formed of a nonmagnetic material, and is rotated in the direction indicated by the arrow in FIG. 1 during the developing operation, and holds the two-component developer in a developing container 2 in the form of a layer and carries it to the developing area, and supplies it to the developing area opposed to the photosensitive drum 128 to thereby develop the electrostatic latent image formed on the photosensitive drum 128. The developer after it has developed the electrostatic latent image is carried in accordance with the rotation of the developing sleeve 3 and is collected into the developing container 2.

The developing container 2 is comparted into a first chamber 2*e* which is a developing chamber near the developing sleeve 3 and a second chamber 2*f* which is an agitating chamber, by a partition wall 2*g*, and a first carrying screw 2*a* which is a first carrying member and a second carrying screw 2*b* which is a second carrying member are disposed in the first chamber 2*e* and the second chamber 2*f*, respectively. The developer is circulated and agitated in the developing container 2 by the first carrying screw 2*a* and the second carrying screw 2*b*. The direction of circulation of the developer is a direction from this side of FIG. 1 toward the inner side thereof on the first carrying screw 2*a* side, and is a direction from the inner side of FIG. 1 toward this side thereof on the second carrying screw 2*b* side.

The mixing ratio of the toner and carrier in this supplied developer is of the order of 9:1 by weight ratio, but is not particularly restricted to this numerical value. That is, the amount of toner is overwhelmingly great relative to the ratio of the two-component developer in the developing container 2, and considering the volume ratio, a slight amount of carrier can be considered to be mixed with the toner. That is, when the toner consumed by image forming is to be made up for, a slight amount of carrier is gradually supplied.

If the proportion of the carrier of the supplied developer becomes great, the substituting amount of the carrier becomes great by the supply of the same amount of toner, and the two-component developer in the developing apparatus 1 approximates a fresh state, but correspondingly thereto, the consumed amount of the carrier becomes great. Therefore, in respective developing apparatuses, it is preferable to discretely determine the mixing ratio.

When the consumption of the toner by image forming and the supply of the toner by toner supply amount controlling means are repeated, the carrier supplied with the supply of the toner is increased in the developing container 2. The toner density in the two-component developer is kept substantially constant by the toner supply amount controlling means and therefore, the amount of developer in the developing container is increased. Any excess two-component developer which has passed through the opening portion of a developer discharge port 2*d* is collected into a collecting container 5*b* made integral with a supplying container 5*a*.

The supply of the developer and the collection of the developer will now be described in detail.

The supplying container 5*a* in which the toner and carrier to be supplied are contained and the collecting container 5*b* for collecting therein the excessive developer in the developing container 2 (excess developer) are made integral with each other to thereby constitute a developer cartridge 5.

Figure 3:
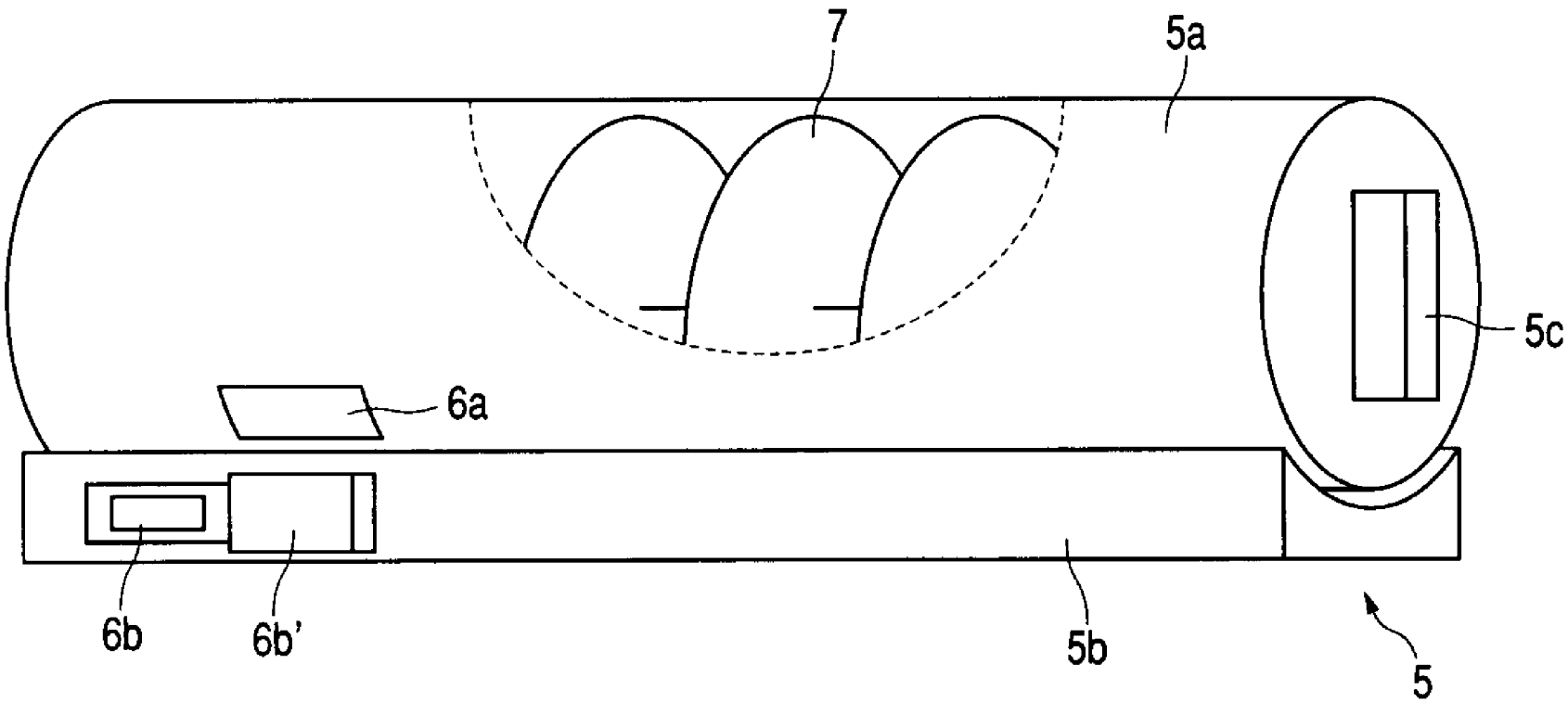
FIG. 3 is a perspective view showing an example of each of the supplying container and the collecting container according to the present invention.

The developer cartridge 5, as shown in FIG. 3, is constituted by a substantially cylindrical supplied developer containing portion 5*a* which is a supplying container portion, and a collected developer containing portion 5*b* which is a collecting container portion, and is easily detachable from an image forming apparatus main body.

When the developer cartridge 5 is inserted into the image forming apparatus from this side, a shutter mechanism 6*b*' slides and a developer collecting port 6*b* opens, and a handle 5*c* on this side is twirled, whereby the supplied developer containing portion 5*a* is rotated while the collected developer containing portion 5*b* remains fixed to the image forming apparatus main body and a developer supplying port 6*a* communicating with the developer supplying port 2*i* of the developing container 2 opens.

When the developer cartridge 5 is to be detached from the image forming apparatus, the handle 5*c* is twirled to the left, whereby the two opening portions are closed, and it never happens that the contained powder leaks to the outside.

Also, in the supplied developer containing portion 5*a*, there is contained an agitating member 7 for agitating the supplied developer. The interior of the developer cartridge 5 is partly shown in FIG. 3, and the agitating member 7, as shown therein, is such that resin film formed into a spiral shape is rotatively driven by a shaft of a rigid material, and it is suitably rotated to thereby agitate the developer in the supplied developer containing portion 5*a* and assist the supply of the developer.

The amount of toner consumed by image forming passes from the supplied developer containing portion 5*a* and through the developer supplying port 6*a* by the rotational force of the agitating member 7 and gravity, and is carried to a supplying screw 8 disposed in the developer supplying port 2*i* of the developing container 2 as shown in FIG. 1, and is supplied to the agitating chamber 2*f* in the developing container 2 in which the developing sleeve 3 is not installed, in accordance with the rotation of the supplying screw 8.

In this manner, the developer to be supplied is supplied from the developer cartridge 5 to the developing apparatus 1.

Also, the amount of supply of the toner (and carrier) is nearly determined by the number of revolutions of the supplying screw 8, which in turn is determined by toner supply amount controlling means (not shown). As toner supply amount controlling methods, there are known various methods such as a method of optically or magnetically detecting the toner density in the two-component developer, and a method of developing a reference latent image on the photosensitive drum 128 and detecting the density of the toner image and therefore, it is possible to suitably choose one of those methods.

Of the excess two-component developer caused by the consumption of the toner by image forming and the supply of the toner by the toner supply amount controlling means, an amount passing through the developer discharge port 2*d* provided on the agitating chamber 2*f* side falls from the developer collecting port 6*b* into the collected developer containing portion 5*b* and is collected thereby.

The developer supplying port 6*a* and the developer supplying port 2*i* of the developing container 2 are located toward the axially inner side of the developing container 2 in the insertion direction of the developer cartridge 5, and the developer collecting port 6*b* and the developer discharge port 2*d* of the developing container 2 are located somewhat more toward the inner side than the developer supplying port 6*a*.

That is, the developer discharge port 2*d* provided on the agitating chamber 2*f* side is located upstream of the developer supplying port 2*i* with respect to the direction of circulation of the developer in the developing container 2, and the fresh carrier supplied through the developer supplying port 2*i* is contained in the developing container 2 and is mixed and agitated with the two-component developer circulated from the agitating chamber 2*f*, by at least one round of circulation in the developing container 2, and the greater part of the developer discharged through the developer discharge port 2*d* and collected into the collected developer containing portion 5*b* through the developer collecting port 6*b* is the old developer which has repeated image forming in the developing apparatus 1. In this manner, the replacement of the two-component developer is gradually effected.

In such a developing apparatus, as described in the example of the conventional art, when the amount of developer or the bulk density changes and the level of the developer in the other places than the discharge port becomes unstable, there has been a case where when the amount of developer is too much increased, there arises the problem that overtorque occurs and a high quality of image cannot be maintained.

In the present embodiment, design is made such that a change in the level of the developer near the discharge port during the carrying of the developer, for a change in the amount of developer or the bulk density of the developer is made greater than a change in the level of the developer in the other places in the developing apparatus to thereby stabilize the level of the developer in the developing apparatus (reduce the ripple of the discharged amount of the excess developer), and avoid the overtorque.

Description will now be made of a change in the level of the developer when the developer is discharged through the developer discharge port, such as when the level of the developer in places other than the discharge port has become unstable due to the amount of developer or the bulk density having changed, which is a characteristic feature of the present embodiment.

In the present embodiment, the structure of the second carrying screw for agitating and carrying the developer in the agitating chamber 2*f* wherein the developer is supplied and discharged is contrived to thereby adjust the level of the developer.

Figure 2:
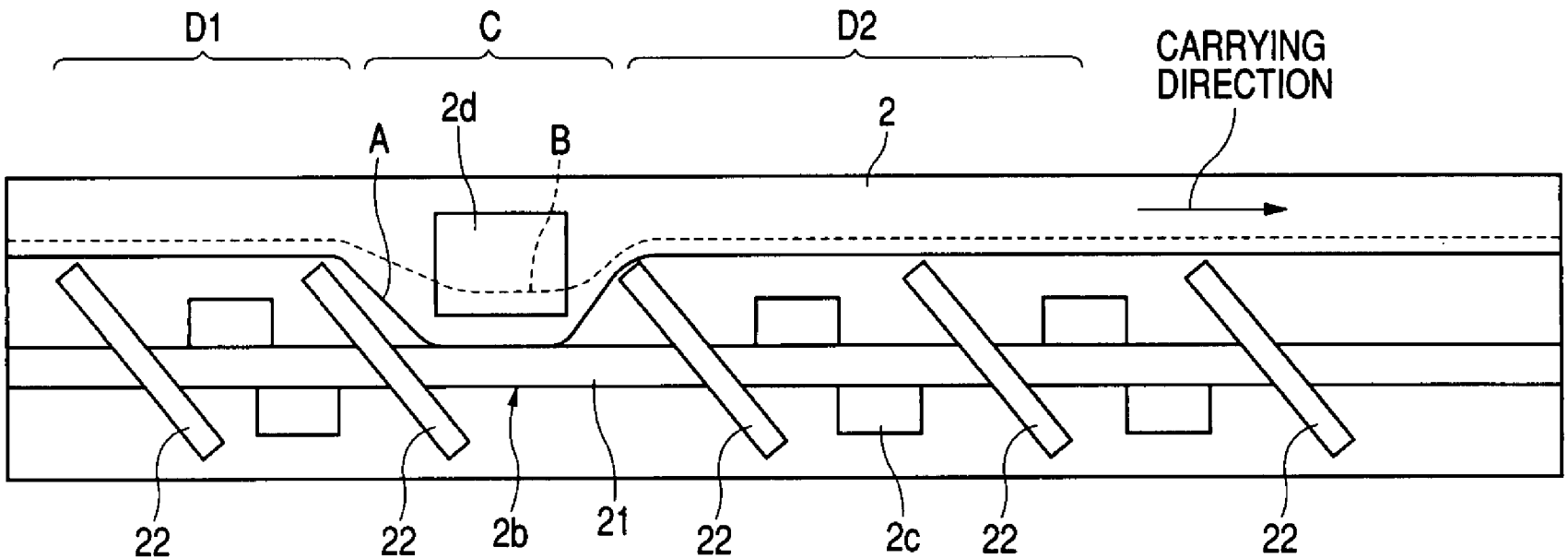
FIG. 2 is a longitudinal cross-sectional view showing an example of an agitating chamber according to the present invention.

FIG. 2 is a view of the vicinity of the developer discharge port 2*d* of the developing apparatus 1 as it is seen from the agitating chamber 2*f* side.

Each of the first carrying screw 2*a* and the second carrying screw 2*b* is such that a plurality of screw vanes 22 which are agitating vanes having a pitch of 24 mm are uniformly provided on a rotary shaft 21 having an outer diameter of 20 mm in the axial direction thereof, and ribs 2*c* as agitation promoting members are equidistantly arranged among the screw vanes 22. The rib 2*c*, however is not disposed only in that portion of the second carrying screw 2*b* which is near the developer discharge port 2*d*. That is, the carrying capability of the second carrying screw 2*b* in the developer carrying direction is great in an area C (FIG. 2) near the discharge port, and is small in an area D1 upstream, and an area D2 (FIG. 2) downstream, of the vicinity of the discharge port in the developer carrying direction.

Accordingly, when the second carrying screw is rotated to thereby carry the developer, the level of the developer in the case of the normal amount of developer becomes such as indicated by solid line A. That is, the level of the developer is low near the developer discharge port 2*d* and the screw vanes are exposed. On the other hand, the level of the developer is high in the areas upstream and downstream of the vicinity of the developer discharge port 2*d* in the developer carrying direction and the screw vanes are embedded in the developer. Accordingly, it becomes possible to adopt a construction for gradually interchanging the developer, yet not increase the amount of developer to be contained in the developing container, and when, for example, an image forming job for continuously forming a plurality of solid images (maximum density images) is to be performed, it is possible to prevent faulty image forming in which image density becomes high due to the deficient amount of electrifying changes of the toner attributable to the faulty agitation of the developer, without lowering the throughput of image forming.

When from this state, the amount of developer in the developing container is increased with the supply of the developer, or the bulk density of the developer in the developing container becomes smaller by the atmospheric environment, the level of the developer changes as indicated by the broken line B. That is, the level of the developer near the developer discharge port 2*d* rises more sensitively than the level of the developer in the areas upstream and downstream of the vicinity of the developer discharge port in the developer carrying direction.

This is considered to be because the developer carrying capability in the area C near the discharge port is great, while on the other hand, the developer carrying capability in the area D2 downstream of the vicinity of the discharge port in the developer carrying direction is small and therefore, when the amount of developer in the developing container is increased by the supply of the developer (toner and carrier), the developer exhibits such movement that an amount of excess developer corresponding to this amount of increase is discharged through the discharge port.

Accordingly, before the level of the developer in the areas upstream and downstream of the vicinity of the developer discharge port 2*d* in the developer carrying direction rises at all times and such problems as the faulty agitation of the developer and a rise in the driving torque for driving the second carrying screw arise, a proper amount of excess developer is discharged through the developer discharge port 2*d* and the level of the developer in the developing container (particularly the agitating chambers) can always be kept within a proper range.

While in the present embodiment, the level of the developer is adjusted by the presence or absence of the ribs 2*c* installed on the second carrying screw so that the levels of the developer in the vicinity of the developer discharge port 2*d* and the areas upstream and downstream thereof may differ from each other, the following modification may be adopted.

For example, when the ribs 2*c* are uniformly installed on the portions other than the portions of the first carrying screw 2*a* and the second carrying screw 2*b* which are opposed to the discharge port 2*d* in the axial direction thereof, there may be adopted a construction in which the ribs 2*c* are installed so that in the portions opposed to the discharge port, the mounting interval may differ from that in the other portions, and in such a construction, as in the above-described embodiment, the developer carrying capability of that portion of the second carrying screw 2*b* which is opposed to the discharge port 2*d* can be made greater than the developer carrying capability in the areas upstream and downstream of the vicinity of the developer discharge port 2*d* in the developer carrying direction and therefore, an effect similar to that of the above-described embodiment can be obtained.

Also, besides the example in which the levels of the developer are made different from each other by the presence or absence of the ribs 2*c*, there may be adopted a method of adjusting the level of the developer by the diameter of the screw vanes of the second carrying screw, the diameter of the rotary shaft, etc. However, it is possible to provide the ribs 2*c* and improve the agitating property to thereby make the developer rather stagnate downstream of the discharge port 2*d* with respect to the developer carrying direction, and make the level of the developer near the discharge port 2*d* rise more sensitively than the level of the developer downstream of the vicinity of the discharge port 2*d* in the developer carrying direction.

Also, there may be adopted a construction in which the developer stagnates in the area downstream of the vicinity of the discharge port 2*d* in the developer carrying direction to such a degree as to contact with the ceiling wall of the developing container, and by adopting such a construction, it is possible to make the level of the developer near the discharge port 2*d* rise more sensitively.

As described above, by the developing apparatus of the present invention, the change in the level of the developer near the discharge port during the carrying of the developer, for the change in the amount of developer resulting from the supply of the developer or the bulk density of the developer due to the atmospheric environment can be made greater than the change in the level of the developer in the other places in the developing apparatus to thereby maintain the interior of the developing apparatus at a proper level of the developer. As the result, there can be achieved an object of the present invention which is to realize and provide a developing apparatus in which the developer is gradually automatically interchanged to thereby enhance the maintenance property and even if the developer is made smaller in particle diameter, the faulty agitation of the supplied toner and overtorque or the like do not occur and which maintains a high quality of image under various environments.

While in the above-described embodiment, a developer supplying port and a discharge port are provided in that agitating chamber of the developing container wherein the developing sleeve is not installed, and the structure of the carrying screws is contrived to thereby achieve the object, this is not restrictive, but the present invention can likewise be applied to any developer containing portion in which the discharge (i.e., automatic interchange) of the excess developer is effected.

For example, the present invention can also be applied to a construction in which the developing container is vertically partitioned into a developing chamber and an agitating chamber, or a construction in which a plurality of agitating chambers are provided. When a plurality of agitating chambers are provided, an agitating/carrying member in the agitating chamber provided with a developer discharge port is the above-described second carrying screw.

Also, the image forming apparatus to which the present invention is applied is not restricted to that shown in FIG. 5.

Second Embodiment

A developing cartridge which is a second embodiment of the present invention will now be described with reference to FIG. 4.

Figure 4:
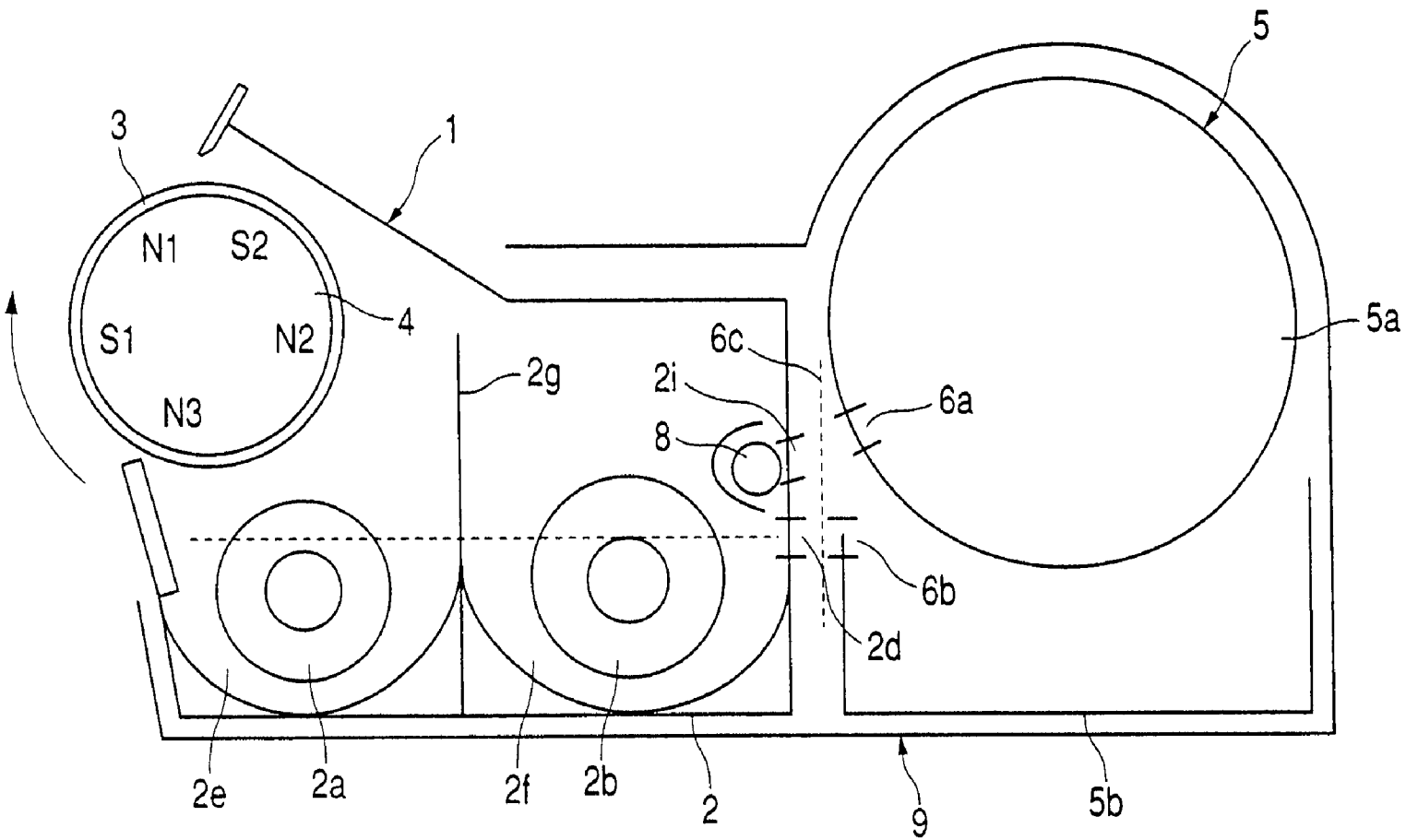
FIG. 4 is a cross-sectional view showing an example of a developing cartridge according to the present invention.

As shown in FIG. 4, the developing cartridge 9 according to the present embodiment is such that the developing apparatus 1 and the developer cartridge 5 in the first embodiment are made integral with each other and made easily detachable from the image forming apparatus main body.

A supplied developer containing portion 5*a* is not rotated as in the first embodiment, but is fixed. Also, before the developing cartridge is mounted on the image forming apparatus, a developer supplying port 6*a* and a developer collecting port 6*b* are sealed by a seal member 6*c*. One end portion of the seal member 6*c* partly protrudes from this side of the developing cartridge 9, and after the developing cartridge 9 is inserted into the image forming apparatus main body from this side thereof, the protruding portion of the seal member 6*c* is pulled out to this side, whereby the developer supplying port 6*a* and the developer discharge port 6*b* are opened.

In the other points, the construction of the developing cartridge, the method of collecting the developer, etc. are similar to those described in the first embodiment.

Third Embodiment

Figure 6:
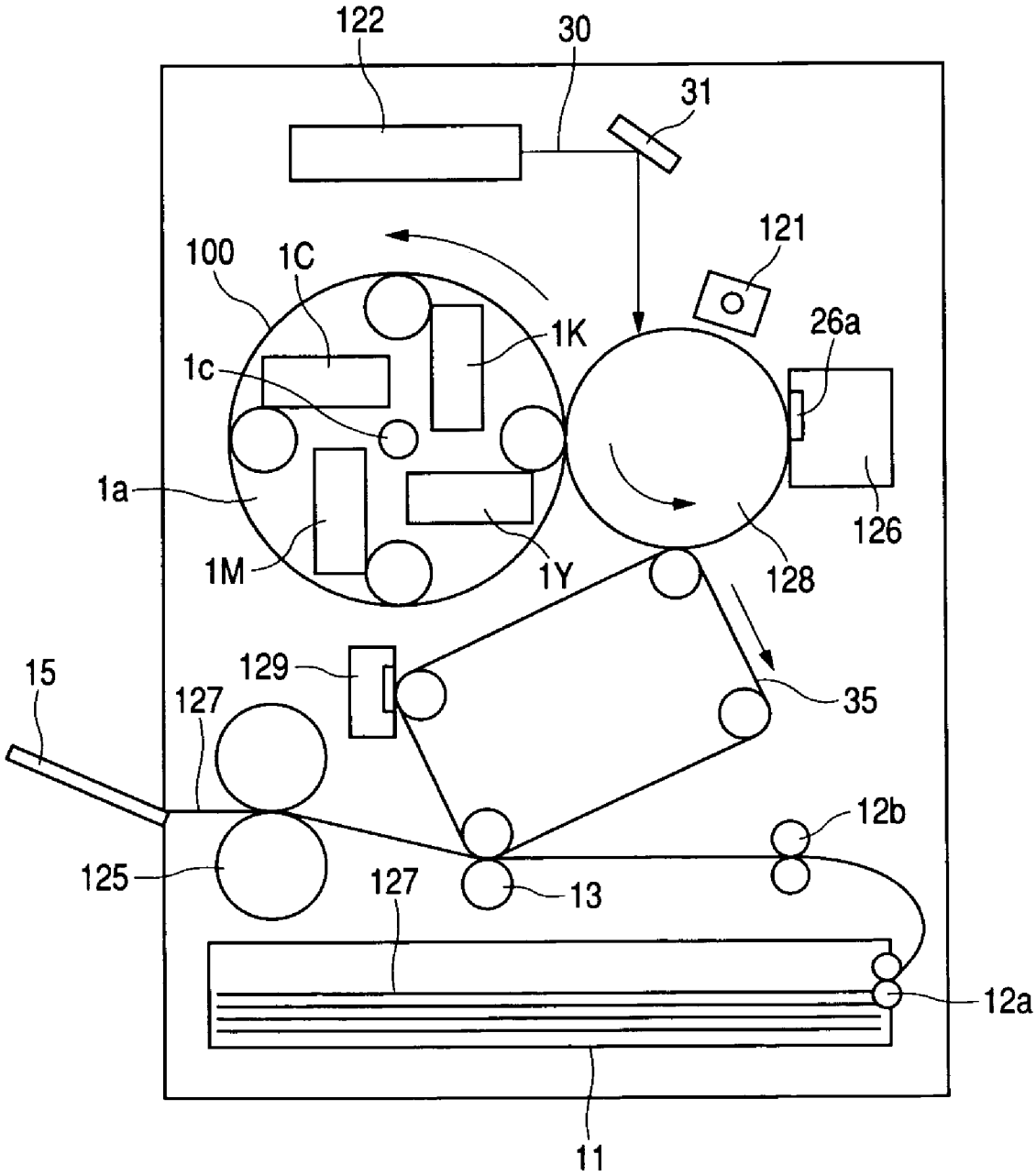
FIG. 6 is a schematic view showing the construction of another example of the image forming apparatus according to the present invention.

Reference is now had to FIG. 6 to describe an image forming apparatus of a rotation changeover developing type which is a third embodiment of the present invention wherein a plurality of developing apparatuses 1 in the first embodiment are disposed in a rotary body (developing rotary).

The electrophotographic image forming apparatus according to the present embodiment is such that a photosensitive drum 128 which is an electrophotographic photosensitive member having a photosensitive layer made of an organic photoconductor formed on a cylindrical base body is mounted for rotation in the direction indicated by the arrow in FIG. 6 at a predetermined peripheral speed.

In the present embodiment, a photosensitive layer of an organic photoconductor is formed on an aluminum cylinder having an outer diameter of 50 mm, and further a surface protecting layer for improving the mold releasability of the toner and preventing the shaving of the photosensitive layer is provided thereon.

The photosensitive drum 128 has its peripheral surface charged to a predetermined polarity and predetermined potential by a charging device 121 which is charging means. The charged surface of the photosensitive drum is subjected to scanning exposure by a laser beam 30 outputted from exposing means 122 and modulated (ON/OFF-converted) correspondingly to the pixel signal of image information inputted from an image signal generating apparatus such as an image reading apparatus or a personal computer (not shown) through a print interface, whereby the electrostatic latent image of the image information is formed thereon.

A laser beam reflecting mirror 31 deflects the output laser beam 30 from the exposing means 122 to the photosensitive drum 128.

Developing means 100 is comprised of a changeover type rotary body (a rotary or rotary developing means) 1*a* containing therein a yellow developing apparatus 1Y, a magenta developing apparatus 1M, a cyan developing apparatus 1C and a black developing apparatus 1K similar in construction to the developing apparatus 1 in the first embodiment.

The rotary developing means 1*a* is supported for rotation in the direction indicated by the arrow in FIG. 6 by a rotary supporting apparatus 1*c*, and is designed such that the aforedescribed color developing apparatuses 1Y, 1M, 1C and 1K are successively opposed to the photosensitive drum 128 and developing by respective color toners is effected.

When the surface of the photosensitive drum 128 is charged by the charging device 121, exposure scanning by the exposing means 122 ON/OFF-controlled in accordance with image data of a first color (e.g. yellow) is done, and an electrostatic latent image of the first color is formed on the photosensitive drum 128. This electrostatic latent image of the first color is developed and visualized by the yellow developing apparatus 1Y containing a yellow agent of the first color. This visualized first toner image is then transferred to the surface of an intermediate transferring member 35 urged against the photosensitive drum 128 with a predetermined pressure force and rotatively driven in the direction indicated by the arrow at a speed (in the present embodiment, 100 mm/s) substantially equal to the peripheral speed of the photosensitive drum 128 in the nip between the photosensitive drum 128 and the intermediate transferring member 35.

During the transfer to the intermediate transferring member 35, a preset voltage opposite in polarity to the charging polarity of the toner is applied to the intermediate transferring member 35. Any toner not transferred to the intermediate transferring member 35 during this transfer but residual on the photosensitive drum 128 is scraped off by a cleaning blade 26*a* which is cleaning means 126 urged against the photosensitive drum 128, and is collected into a waste toner container.

Thereafter the above-described transferring step is likewise repeated for each of the other toners (magenta, cyan and black), and thus, the toner images by the toners of different colors contained in the respective developing apparatuses are successively transferred and layered onto the intermediate transferring member 35, whereby a color image is synthesized and formed.

Also, in FIG. 6, there is installed a cleaner 129 for removing any toners not transferred from the intermediate transferring member 35 to a transferring material 127 but residual on the intermediate transferring member 35.

Transferring materials 127 as recording materials are fed one by one from a feeding cassette 11 to the intermediate transferring member 35 by feeding rollers 12*a* and transporting rollers 12*b*, and a voltage opposite in polarity to the toners is applied from the back of the transferring material 127 to a transferring roller 13, whereby a full-color toner image on the intermediate transferring member 35 is transferred to and is formed on the transferring material 127.

The transferring material 127 to which the full-color toner image has been transferred is then separated from the intermediate transferring member 35 and is introduced into fixing means 125, where it is subjected to the heat-fixing of the toner image thereon and is delivered to a delivery tray 15.

By the developing apparatuses and developer cartridges being mounted in such a rotary body, the present invention can also be applied to a color image forming apparatus. By contriving the opening and closing of developer supplying ports and developer discharge ports, it is also possible to mount in the rotary body the developing cartridge described in the second embodiment wherein the developing container, the collecting container and the developing apparatus are made integral with one another.

The present invention can also be applied to an image forming apparatus of an in-line type in which a photosensitive drum as an image bearing member is installed for each color, and image forming means including the above-described developing apparatus is installed for each photosensitive drum.

What is claimed is:

1. A developing apparatus comprising:

a developer container for containing developer including toner and carrier;

a first carrying member, provided in said developer container, for carrying the developer to develop an electrostatic image formed on an image bearing member;

a second carrying member, provided in said developer container, for rotating to carry the developer in a rotation axial direction of said second carrying member;

a developer supplying device, which supplies said developer container with supplemental developer including toner and carrier; and a discharge opening, provided in an area of said developer container in which the developer is carried by said second carrying member, for discharging out of said developer container through said discharge opening excess developer resulting from a supply of the supplemental developer, wherein a developer carrying capability in the rotation axial direction of said second carrying member is greater in an area near said discharge opening than in an area downstream of said discharge opening in a carrying direction of the developer.

2. A developing apparatus according to claim 1, wherein the developer carrying capability of said second carrying member is set so that a level of the developer in the area near said discharge opening may be lower than that in a contour portion of said second carrying member and that a level of the developer in the area downstream of said discharge opening in the carrying direction of the developer may be higher than the contour portion of said second carrying member.

3. A developing apparatus according to claim 2, wherein said second carrying member has a spiral wing portion provided on a rotary shaft, and an agitating rib provided on said rotary shaft, and said agitating rib is not provided in the area near said discharge opening, but is provided in the area downstream of said discharge opening in the carrying direction of the developer.

4. A developing apparatus according to claim 1, wherein the developer carrying capability of said second carrying member is greater in the area near said discharge opening than in an area upstream of said discharge opening in the carrying direction of the developer.

5. A developing apparatus according to claim 4, wherein the developer carrying capability of said second carrying member is set so that a level of the developer in the area near said discharge opening may be lower than that in a contour portion of said second carrying member and that a level of the developer in the areas upstream and downstream of said discharge opening in the carrying direction of the developer may be higher than that in the contour portion of said second carrying member.

6. A developing apparatus according to claim 5, wherein said second carrying member has on a rotary shaft a spiral wing portion for carrying the developer, and an agitating rib is provided on said rotary shaft except for the area near said discharge opening.

7. A developing apparatus according to claim 1 or 4, wherein said developer container has a developing chamber in which said first carrying member is provided, and an agitating chamber provided with said second carrying member and said discharge opening, a developer circulating route being constituted between said agitating chamber and said developing chamber.

* * * * *

UNITED STATES PATENT AND TRADEMARK OFFICE

CERTIFICATE OF CORRECTION

PATENT NO. : 6,978,106 B2
DATED : December 20, 2005
INVENTOR(S) : Koji Masuda

It is certified that error appears in the above-identified patent and that said Letters Patent is hereby corrected as shown below:

Title page,
Item [56], References Cited, U.S. PATENT DOCUMENTS,
"06274030 A" should read -- 06-274030 A --;
"2001083802 A" should read -- 2001-083802 A --; and
"2001343825 A" should read -- 2001-343825 A --.

Column 9,
Line 19, "had" should read -- made --.

Column 10,
Line 1, "(e.g." should read -- e.g., --.

Signed and Sealed this

Sixth Day of June, 2006

JON W. DUDAS
*Director of the United States Patent and Trademark Office*